US009661921B1

(12) United States Patent
Tsai

(10) Patent No.: US 9,661,921 B1
(45) Date of Patent: May 30, 2017

(54) MULTIPLE SHELVING APPARATUS

(71) Applicant: Frank Tsai, Shenzhen (CN)

(72) Inventor: Frank Tsai, Shenzhen (CN)

( * ) Notice: Subject to any disclaimer, the term of this patent is extended or adjusted under 35 U.S.C. 154(b) by 0 days.

(21) Appl. No.: 15/259,040

(22) Filed: Sep. 7, 2016

Related U.S. Application Data

(63) Continuation-in-part of application No. 15/047,646, filed on Feb. 19, 2016.

(51) Int. Cl.
*A47B 57/50* (2006.01)
*A47B 47/00* (2006.01)
*A47B 55/02* (2006.01)

(52) U.S. Cl.
CPC ..... *A47B 57/50* (2013.01); *A47B 47/0083* (2013.01); *A47B 55/02* (2013.01)

(58) Field of Classification Search
CPC ..... A47B 57/402; A47B 57/40; A47B 57/406; A47B 57/50; A47B 57/482; A47B 57/408; A47B 57/34; A47B 57/00; A47B 96/1441; A47B 96/02; A47B 96/06; A47B 96/14; A47B 96/1408; A47B 96/1416; A47B 47/021; A47B 47/02; A47B 47/028; A47B 47/0083; A47B 47/024; A47B 55/02; F16B 21/09
USPC ..... 211/187, 191, 192
See application file for complete search history.

(56) References Cited

U.S. PATENT DOCUMENTS 3,142,386 A * 7/1964 Skubic ..... A47B 57/402 211/182
3,151,745 A * 10/1964 Reilly ..... A47B 57/402 211/191
3,303,937 A * 2/1967 McConnell ..... A47B 57/50 211/187
3,352,584 A * 11/1967 Engel ..... A47B 57/402 211/192
3,392,848 A * 7/1968 McConnell ..... A47B 57/50 211/192
4,285,436 A * 8/1981 Konstant ..... A47B 57/482 211/192
4,342,397 A * 8/1982 Halstrick ..... A47B 57/402 211/182
9,027,767 B2 * 5/2015 Buckley ..... A47F 5/00 211/134
2002/0153341 A1 * 10/2002 May ..... A47B 57/402 211/192

(Continued)

*Primary Examiner* — Patrick Hawn
(74) *Attorney, Agent, or Firm* — Raymond Y. Chan; David and Raymond Patent Firm

(57) ABSTRACT

A frame of a shelving apparatus includes a plurality of vertical posts, a plurality of cross members, and a plurality of shelf supporting beams. Each vertical post has an inner attachment surface, a side surface, and a plurality of attachment slots formed at the inner attachment surface. Each shelf supporting beam includes a beam member and two post lockers provided at two ends of the beam member respectively. Each post locker includes an extension wall biasing against the side surface, a locker wall biasing against the inner attachment surface, and a locking element provided at the locker wall to to selectively engage with one of the attachment slots so as to detachably couple the shelf supporting beam between the vertical posts at a position that the beam member is extended between the side surfaces of the vertical posts.

2 Claims, 13 Drawing Sheets

(56) References Cited

U.S. PATENT DOCUMENTS

| | | | | |
|---|---|---|---|---|
| 2005/0103734 | A1* | 5/2005 | Saltzberg | A47B 57/50 211/187 |
| 2010/0006526 | A1* | 1/2010 | Konstant | A47B 47/021 211/134 |
| 2012/0000872 | A1* | 1/2012 | Troyner | A47B 47/021 211/150 |
| 2012/0000873 | A1* | 1/2012 | Fitzgerald | A47B 57/50 211/153 |
| 2012/0067838 | A1* | 3/2012 | Lawson | A47B 47/028 211/134 |
| 2015/0090683 | A1* | 4/2015 | Sabounjian | A47B 96/14 211/186 |

* cited by examiner

MULTIPLE SHELVING APPARATUS

CROSS REFERENCE OF RELATED APPLICATION

This is a Continuation-In-Part application that claims priority to U.S. non-provisional application, application Ser. No. 15/047,646, filed Feb. 19, 2016, the entire contents of each of which are expressly incorporated herein by reference.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a shelving apparatus, and more particularly to a multiple shelving apparatus, wherein two ends of the beam member can be quickly attached to two vertical posts for substantially distributing the weight force of an object to the vertical posts.

Description of Related Arts

A conventional shelf structure comprises four vertical posts vertically extended from four corners of the shelf structure and a plurality of supporting panels horizontally and spacedly coupled at the vertical posts to form a shelving unit for supporting objects. In addition, each supporting panel comprises a plurality of beams coupled between two of the post member and a panel body supported by the beams. For example, U.S. Pat. No. 4,342,397 disclosed a beam coupled between two posts B1. As shown in FIG. 1, the beam has an outside vertical wall A1, a bottom wall A2 extending horizontally from the bottom of the vertical wall A1, a top wall A3 extending horizontally from the vertical wall A1 with a vertically downwardly extending wall A4 extending from the top wall A3, an inwardly extending horizontally wall A5 and a vertically downwardly extending wall A6. However, such beam structure has several drawbacks. Accordingly, the beam structure requires two lockers to lock the ends of the beam with the posts B1 respectively. In particular, each locker has a locking mechanism to lock up the bottom wall A2 and the horizontally wall A5 of the beam to the post B1, such that when the object is supported on the supporting panel, the downward weighting force of the object will substantially exert to the bottom wall A2 and the horizontally wall A5 to create stress thereat. Since the bottom wall A2 and the horizontally wall A5 are spacedly extended from the vertical wall A1 of the beam, the excessive downward force of the object will bend the bottom wall A2 and the horizontally wall A5, and even twist the beam. Once the bottom wall A2 or the horizontally wall A5 is bent or deformed, the beam cannot be stably supported by the post B1. In addition, the locking engagement between the beam and the locker requires a clearance in order to enable the bottom wall A2 and the horizontally wall A5 to be locked up with the locker. The clearance will create an unwanted movement between the beam and the post B1. Therefore, the overall structure of the shelving unit become wobble and unstable.

Furthermore, each post B1 has a post wall B2 and a plurality of rectangular openings B3 spacedly formed on the post wall B2. When the beam is coupled at the post wall B2 of the post B1 through the rectangular openings B3, stress will create at the rectangular openings B3 and will transfer to post wall B2. It is worth mentioning that the post B1 is made of rectangular hollow sheet metal, such that the stress at the rectangular opening B3 will tear the post wall B2. Especially when two columns of rectangular openings B3 are formed on the same post wall B2 of the post B1 for connecting with two beams, the two opposed stress force from two beams will oppositely tear the post wall B2 apart. In other words, the overall structure of the shelving unit will be collapsed once the post B1 is broken.

SUMMARY OF THE PRESENT INVENTION

The invention is advantageous in that it provides a multiple shelving apparatus, wherein an end of the beam member can be quickly and rigidly attached to a vertical post for substantially distributing the weight force of an object to the posts.

Another advantage of the invention is to a multiple shelving apparatus, wherein the beam member is double-locked up with vertical post to prevent any unwanted lateral or twisting movement between the beam member and the vertical post so as to prevent any deformation of the beam member or the vertical post in response to the weight force of the object.

Another advantage of the invention is to a multiple shelving apparatus, wherein the recessed beam flange is configured to have a folded double-wall structure to substantially support the shelf platform. Accordingly, the supporting frame can withstand 1500 lbs of object without collapsing the shelving apparatus.

Another advantage of the invention is to a multiple shelving apparatus, wherein the beam member has a built-in reinforcing structure to prevent any twisting movement of the beam member so as to provide a rigid structure to support the weight of the object and to distribute the weight of the object to the vertical post.

Another advantage of the invention is to a multiple shelving apparatus, wherein a longitudinal size of the shelving structure can be selectively expanded by coupling two beam members to two sides of one single vertical post respectively.

Another advantage of the invention is to a multiple shelving apparatus, which provides different supporting orientations to selectively adjust a depth of the supporting frame.

Another advantage of the invention is to a multiple shelving apparatus, wherein the shelf platform is reversibly supported by the shelf retaining members to selectively adjust the depth of the supporting frame. In other words, the user is able to selectively adjust the depth of supporting frame without disassembling the vertical posts.

Another advantage of the invention is to provide a multiple shelving apparatus, wherein no expensive or complicated structure is required to employ in the present invention in order to achieve the above mentioned objects. Therefore, the present invention successfully provides an economic and efficient solution for providing a rigid configuration for the multiple shelving apparatus.

Additional advantages and features of the invention will become apparent from the description which follows, and may be realized by means of the instrumentalities and combinations particular point out in the appended claims.

According to the present invention, the foregoing and other objects and advantages are attained by a shelving apparatus, comprising a plurality of vertical posts and a supporting frame.

Each of the vertical posts has an inner attachment surface, a side surface perpendicularly extended from the inner attachment surface, and a plurality of attachment slots spacedly formed at the inner attachment surface.

The supporting frame comprises a shelf platform and a plurality of shelf supporting beams for supporting the shelf platform. Each of the shelf supporting beams comprises a beam member and two post lockers provided at two ends of the beam member to detachably couple at two of the vertical posts respectively. Each of the post lockers comprises an extension wall perpendicularly extended from the beam member to bias against the side surface of the vertical post, a locker wall perpendicularly extended from the extension wall to bias against the inner attachment surface of the vertical post, and at least a locking element provided at the locker wall to selectively engage with at least one of the attachment slots so as to detachably couple the shelf supporting beam between the vertical posts at a position that the beam member is extended between the side surfaces of the vertical posts.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 2 to 6, a shelving apparatus according to a preferred embodiment of the present invention is illustrated, wherein the shelving apparatus comprises a plurality of vertical posts 10 and one or more supporting frames. Each of the supporting frame comprises a shelf platform 20 and a plurality of shelf supporting beams 30 for supporting the shelf platform 20.

Figure 3:
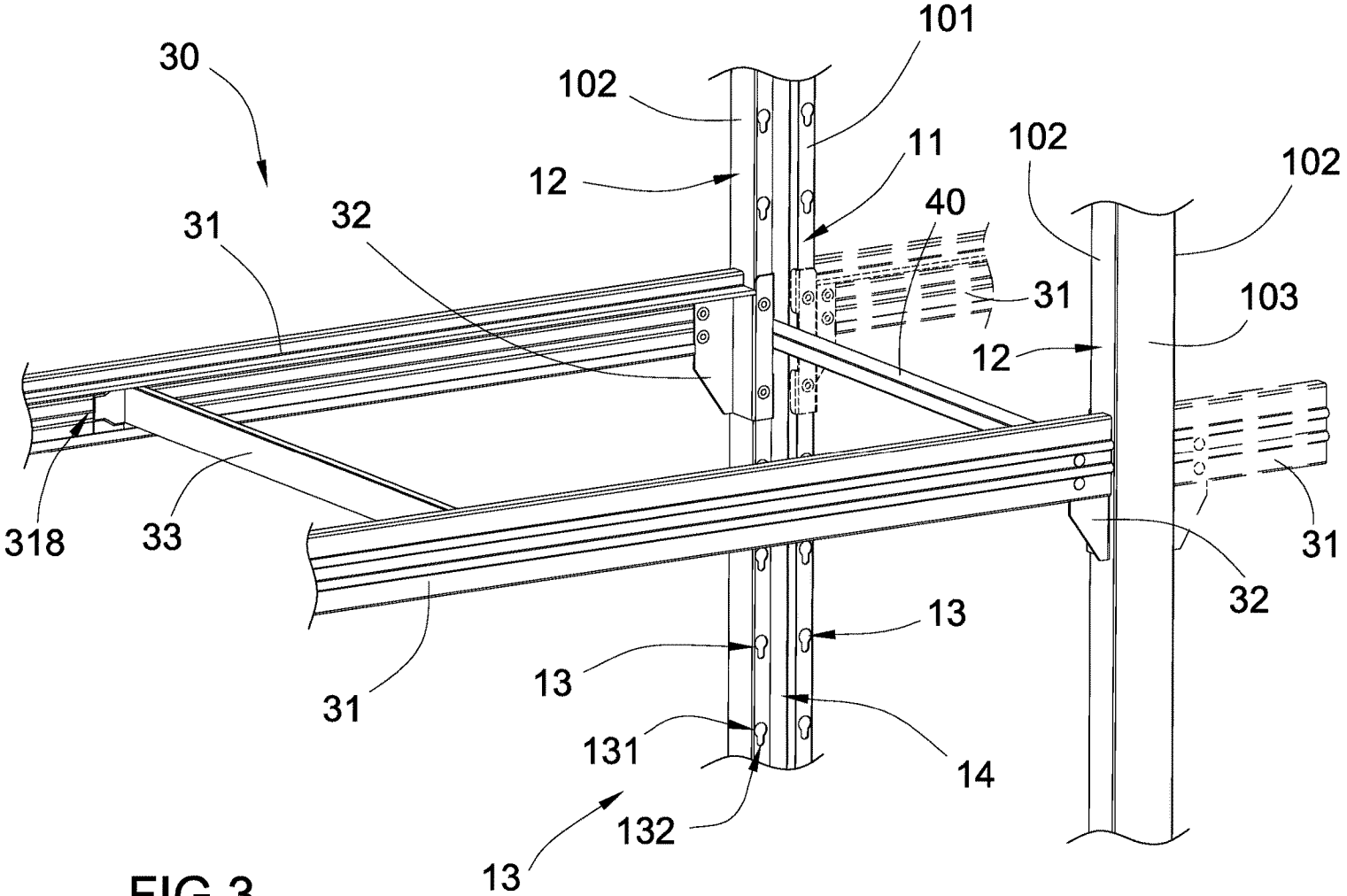
FIG. 3 is a partially perspective view of the post locker of the shelving apparatus according to the above preferred embodiment of the present invention.

Each of the vertical posts 10 is supported in a vertically oriented manner to serve as a corner post of the shelving apparatus. In one embodiment, four vertical posts 10 are provided that four corners of the supporting frame are coupled at the vertical posts 10 respectively. According to the preferred embodiment, each of the vertical posts 10 generally has a rectangular cross section and defines an inner wall 101, two sidewalls 102 spacedly extended from the inner wall 101, and an outer wall 103 extended from the sidewalls 103 that the outer wall 103 is spaced apart from the inner wall 101. In particular, each of the vertical post 10 has an inner attachment surface 11 defined on the inner wall 101, two side surfaces 12 integrally and perpendicularly extended from the inner attachment surface 11 and defined on the two sidewalls 102 respectively, and a plurality of attachment slots 13 spacedly formed at the inner attachment surface 11. It is worth mentioning that, as shown in FIG. 3, the inner attachment surfaces 11 of the two vertical posts 10 in a transverse direction of the shelving apparatus face toward each other while the side surfaces 12 of the two vertical posts 10 in a longitudinal direction of the shelving apparatus face toward each other. In addition, the side surfaces 12 and an outer surface at the outer wall 103 of the vertical post 10 are flat and smooth surfaces that no hole or slot is formed thereon.

Figure 4:
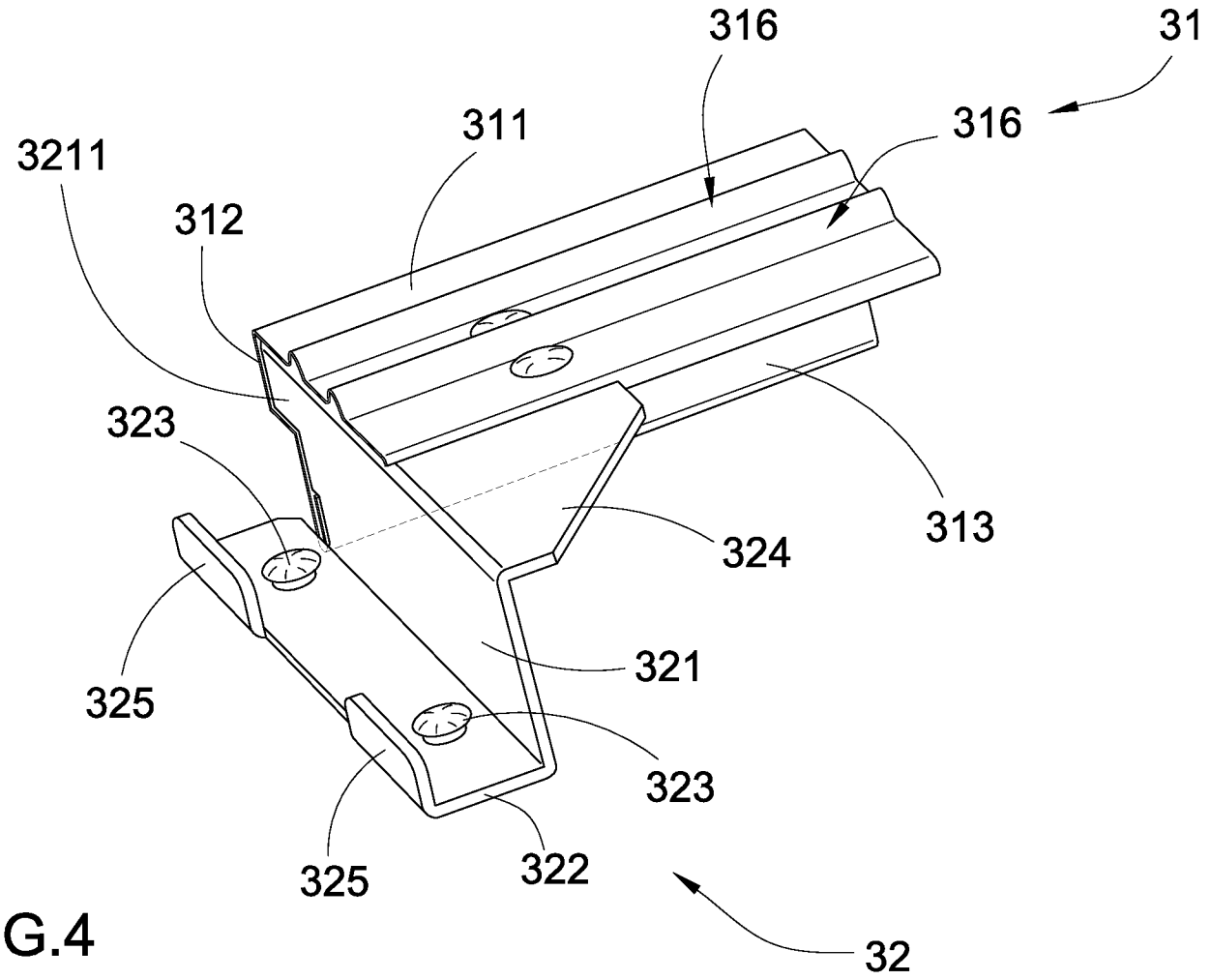
FIG. 4 is a perspective view of the post locker of the shelving apparatus according to the above preferred embodiment of the present invention.
Figure 5:
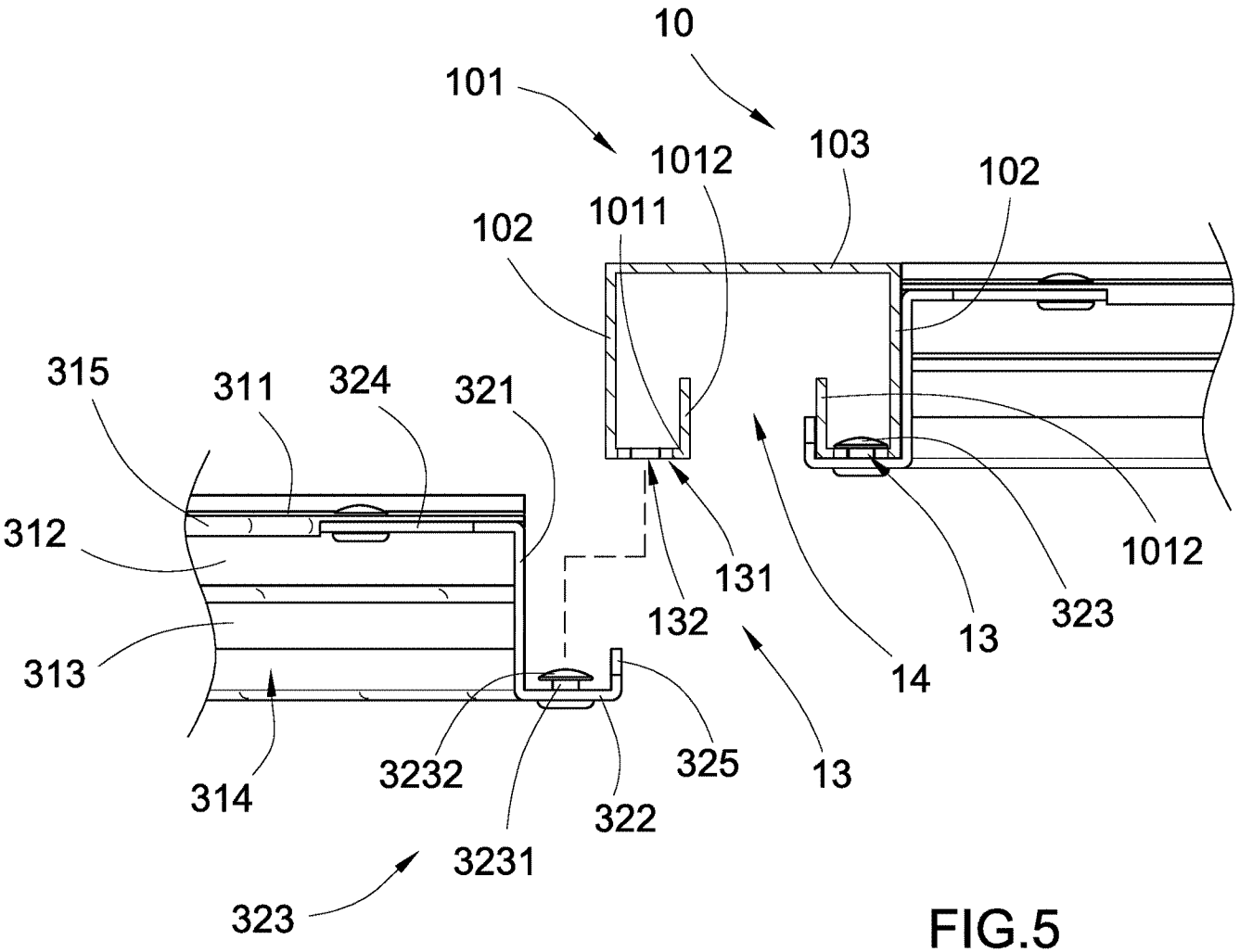
FIG. 5 is a sectional view of the vertical post of the shelving apparatus according to the above preferred embodiment of the present invention, illustrating the post locker coupled at the vertical post.

As shown in FIGS. 3 to 5, each of the vertical post 10 further has a vertical retention slot 14 indented on the inner attachment surface 11. Preferably, the retention slot 14 is formed at the middle of the inner attachment surface 11. In other words, only the inner attachment surface 11 has the attachment slots 13 and the retention slot 14 formed therein. Accordingly, the inner wall 101 has two L-shaped inner wall members, wherein each of the inner wall members has a first inner wall portion 1011 perpendicularly extended from the sidewall 102 and a second inner wall portion 1012 inwardly bent from the first inner wall portion 1011 toward the outer wall 103. The retention slot 14 is defined at a space between the second inner wall portions 1012 of the inner wall members.

The attachment slots 13 are lined up in a column manner. In particular, the attachment slots 13 are formed at the first inner wall portions 1011 of the inner wall members of the inner wall 101. Therefore, two columns of the attachment slots 13 are formed on the inner attachment surface 11 of the vertical post 10 at a position that the retention slot 14 is formed between the columns of the attachment slots 13. Each of the attachment slots 13, having a keyhole configuration, has an enlarged upper slot portion 131 and an elongated lower slot portion 132, wherein a size of the upper hole portion 131 is larger than a size of the lower hole portion 132.

Figure 1:
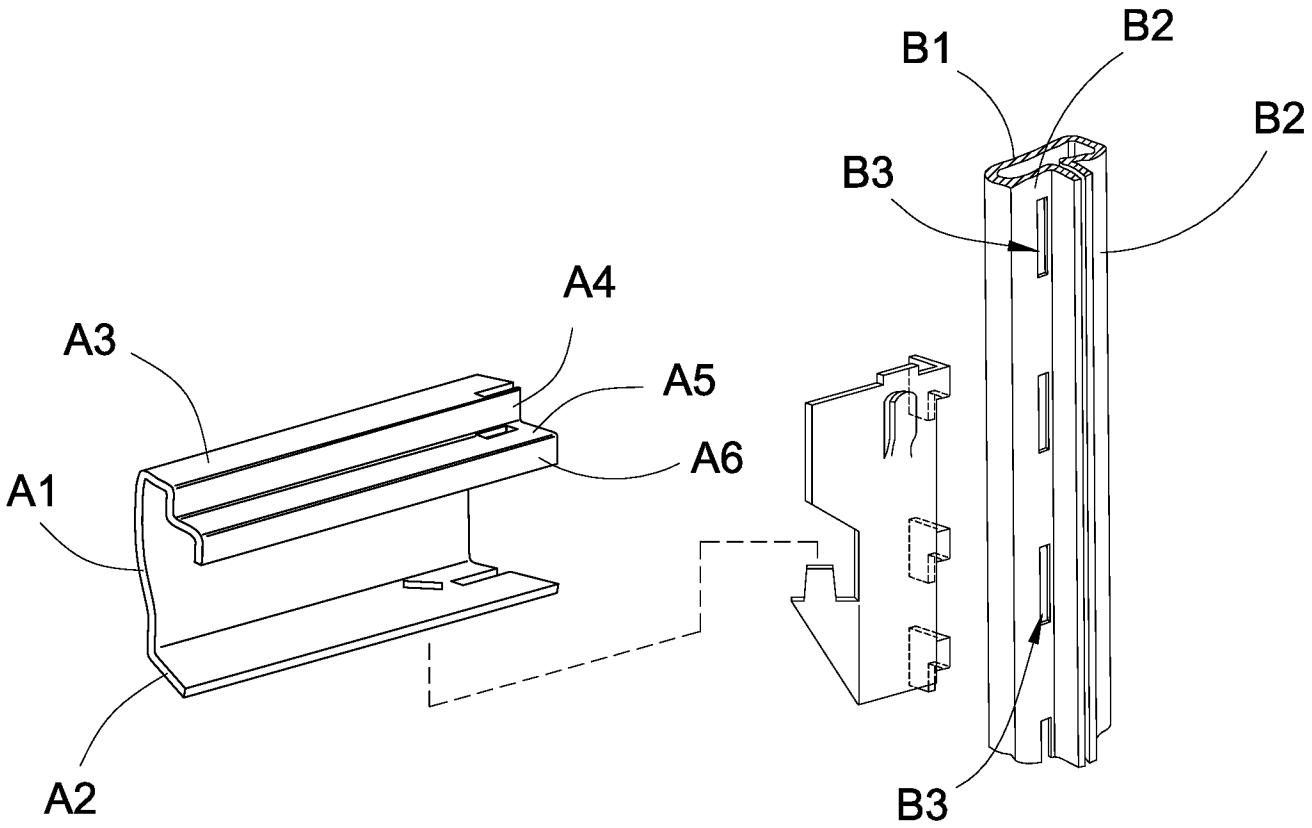
FIG.1 PRIOR ART
FIG. 1 is a sectional perspective view of a beam structure of a conventional shelf.
Figure 2:
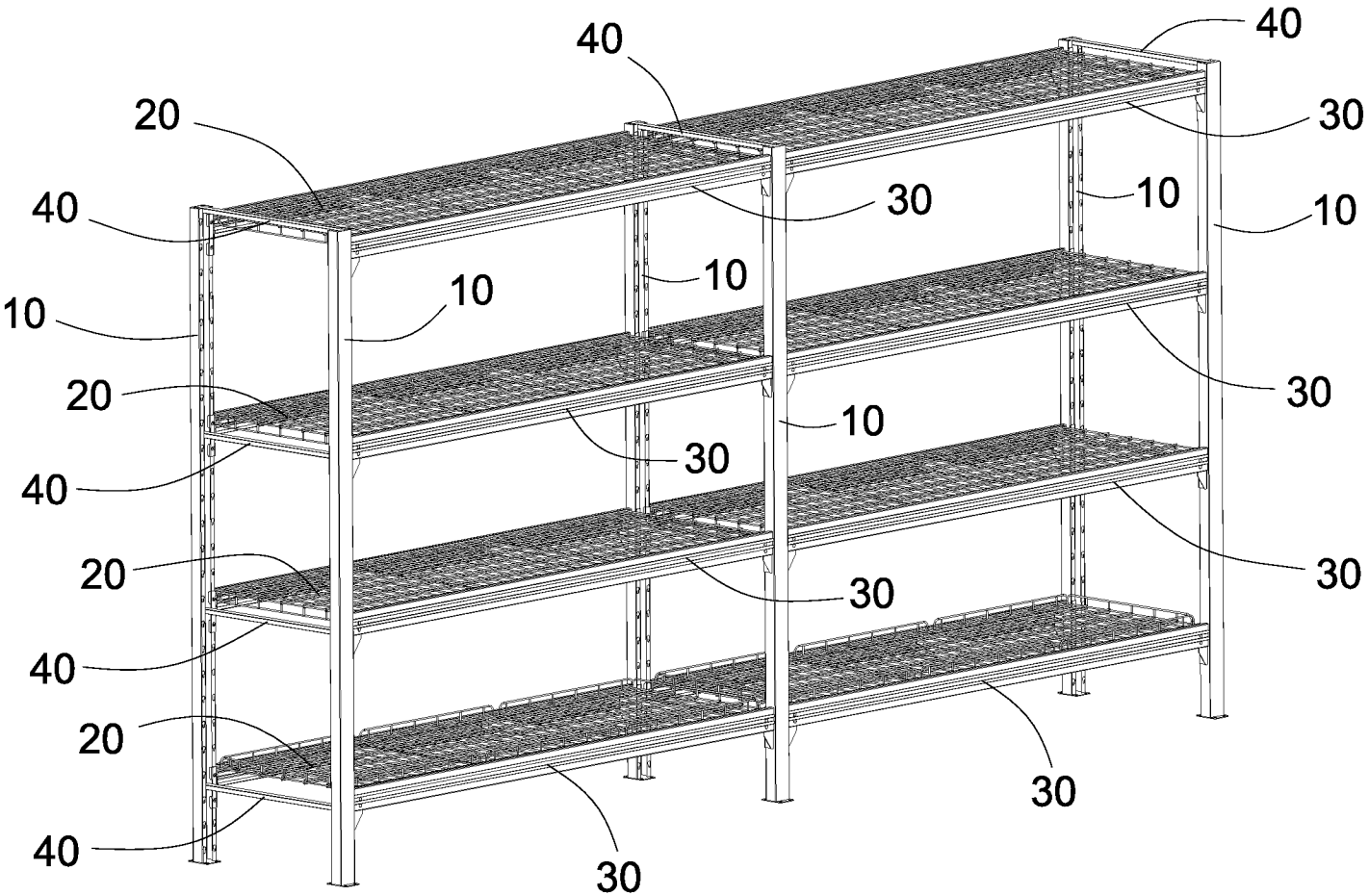
FIG. 2 is a perspective view of the shelving apparatus according to a preferred embodiment of the present invention.

As shown in FIGS. 2 and 3, the supporting frame further comprises a plurality of cross members 40 extended between the vertical posts 10 to form a side boundary of the shelving apparatus. Accordingly, each of the cross members 40 has two ends detachably coupled at the retention slots 14 of the two vertical posts in a transverse direction. In other words, the cross member 40 is perpendicularly extended from the inner attachment surface 11 of the inner wall 101 of the vertical post 10. Preferably, the cross member 40 is located at the same level of the shelf supporting beam 30 that the cross member 40 is perpendicularly aligned the shelf supporting beam 30 end-to-end.

As shown in FIGS. 2 and 3, the supporting frame comprises four different supporting levels, wherein at each supporting level, there are one shelf platform 30, two shelf supporting beams 30, and two cross members 40.

According to the preferred embodiment, the shelf platform 20 is a wire shelf made by a plurality of longitudinal and transverse wires intersecting with each other. It should be appreciated that the shelf platform 20 can be made of other configurations such as solid panel, laminated panel, or other materials such as wood or plastic.

Figure 8:
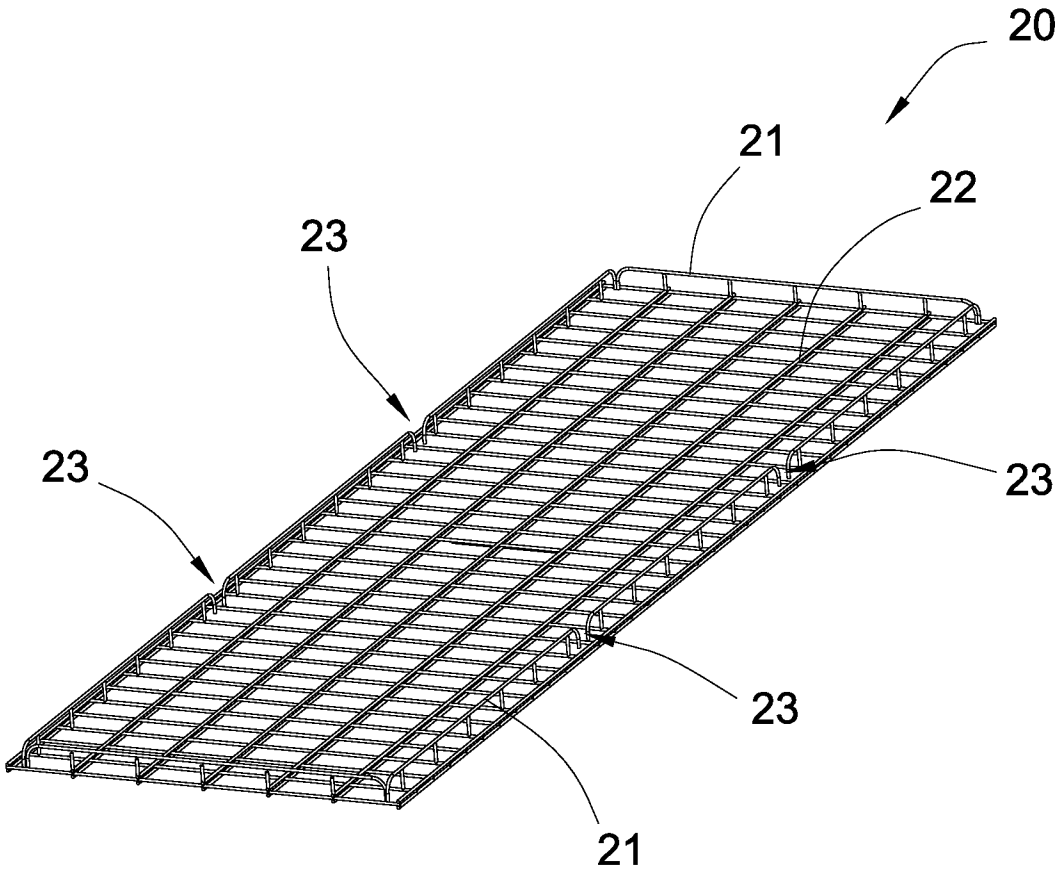
FIG. 8 is a perspective view of the shelf platform of the shelving apparatus according to the above preferred embodiment of the present invention.

As shown in FIG. 8, the shelf platform 20 has a surrounding frame 21 and a base frame 22 located at different horizontal levels of the surrounding frame 21, wherein the shelf platform 20 is reversibly supported by the shelf supporting beams 30. Accordingly, the base frame 22 is constructed to have a wire shelf configuration, wherein the surrounding frame 21 is formed as a surrounding wall and is upwardly extended from the base frame 22. In particular, a circumferential size of the surrounding frame 21 is smaller than a circumferential size of the base frame 22.

Each of the shelf supporting beams 30 is detachably coupled with two of the vertical posts 10, such that the shelf supporting beams 30 form a boundary frame to support the shelf platform 20 therewithin. In particular, each of the shelf supporting beams 30 has two ends arranged for detachably coupling with two of the vertical posts 10. Accordingly, two of the shelf supporting beams 30 serve as a front boundary and a rear boundary respectively, such that the boundary frame is formed between the front boundary and the rear boundary. Preferably, the length of the front boundary matches with the length of the rear boundary.

As shown in FIGS. 3 to 6, each of the shelf supporting beams 30 comprises a beam member 31 and two post lockers 32 provided at two ends of the beam member 31 to detachably couple at two of the vertical posts 10 respectively.

Figure 6:
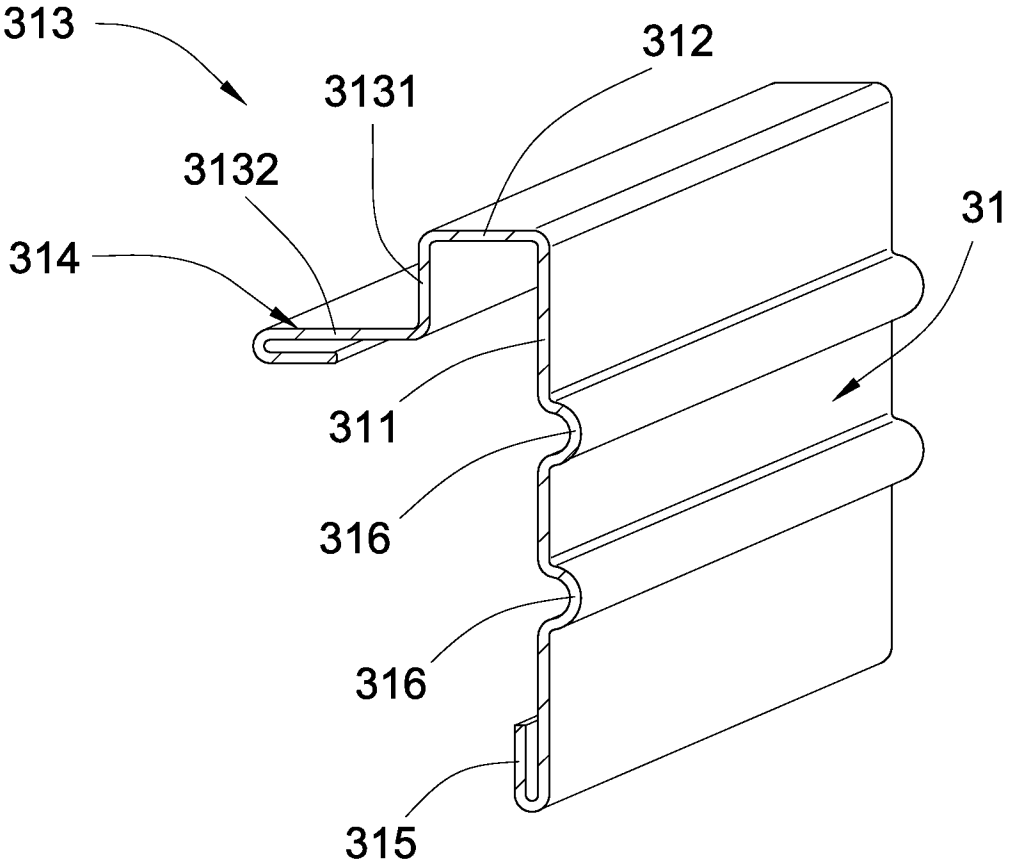
FIG. 6 is a sectional view of the beam member of the shelving apparatus according to the above preferred embodiment of the present invention.

Each of the beam members 31 has a planar structure to be detachably coupled at two of the vertical posts 10 via the post lockers 32. As shown in FIG. 6, each of the beam members 31 comprises a vertical beam wall 311, a top beam wall 312 integrally and horizontally extended from a top edge of the vertical beam wall 311, and a recessed beam flange 313 integrally extended from the top beam wall 312 to define a platform supporting surface 314 to support the shelf platform 20 thereon.

The recessed beam flange 313 comprises a vertical flange wall 3131 downwardly extended the top beam wall and a U-shaped folded platform supporting wall 3132 integrally and horizontally extended from the vertical flange wall 3131 to define the platform supporting surface 314 on the folded platform supporting wall 3132. Accordingly, the folded platform supporting wall 3132 has a double wall structure not only for rigidly supporting the shelf platform 20 on the platform supporting surface 314 but also reinforce the structure of the recessed beam flange 313 to prevent any twisting movement or torque created thereat when the object is placed and supported on the shelf platform 20.

Figure 9A:
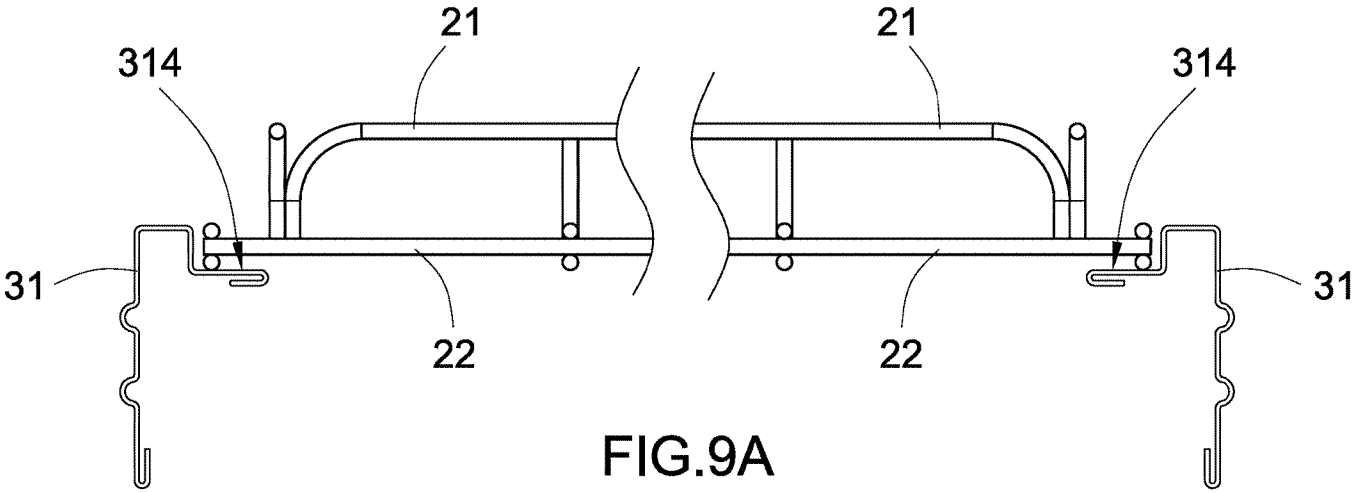
FIG. 9A illustrates the shelf platform supported at the first position according to the above preferred embodiment of the present invention.
Figure 9B:
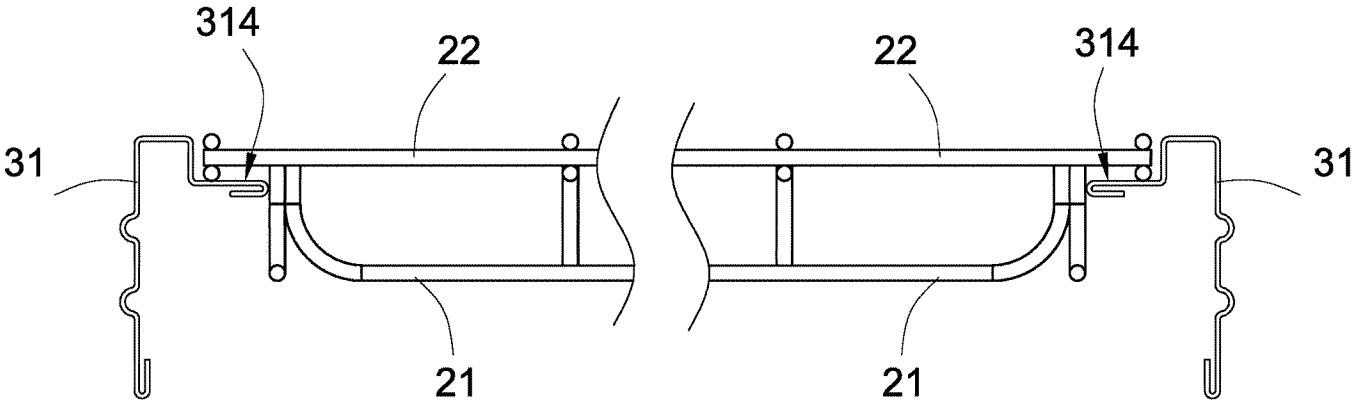
FIG. 9B illustrates the shelf platform supported at second first position according to the above preferred embodiment of the present invention.

As it is mentioned that the shelf platform 20 is reversibly supported by the shelf supporting beams 30. In particular, the base frame 22 of the shelf platform 20 is supported on the platform supporting surfaces 314 of the beam members 31 at a first position and a reversibly second position. At the first position, as shown in FIG. 9A, the base frame 22 is supported by the platform supporting surfaces 314 of the shelf supporting beams 30 at a position that the surrounding frame 21 of the shelf platform 20 is located above the base frame 22 to form an obstruction wall of the shelf platform 20. At the second position, as shown in FIG. 9B, the base frame 22 is supported by the platform supporting surfaces 314 of the shelf supporting beams 30 at a position that the surrounding frame 21 is located below the base frame 22 to form a boundary-less frame structure.

Each of the beam members 31 further comprises a reinforcing wall 315 integrally extended and inwardly folded on the vertical beam wall 313 at a bottom edge thereof to bias against the post locker 32, and at least one longitudinal reinforcing rib 316 integrally and outwardly extended from the vertical beam wall 311. Accordingly, the reinforcing wall 315 is inwardly folded to overlap on an inner side of the vertical beam wall 313 at the bottom edge thereof, wherein the reinforcing wall 315 and the bottom portion of the vertical beam wall 313 also form a double wall structure to reinforce the structure of the vertical beam wall 313 to prevent any twisting movement or torque created thereat. As shown in FIG. 6, two longitudinal reinforcing ribs 316 are extended in parallel, wherein each of the longitudinal reinforcing ribs 316 has a curved cross section integrally bent at a mid-portion of the vertical beam wall 313 to reinforce the structure of the vertical beam wall 313 to prevent any twisting movement or torque created thereat.

As shown in FIGS. 4 and 5, each of the post lockers 32 comprises an extension wall 321 perpendicularly extended from the beam member 31 to bias against the side surface 12 of the vertical post 10, a locker wall 322 perpendicularly extended from the extension wall 321 to bias against the inner attachment surface 11 of the vertical post 10, and at least a locking element 323 provided at the locker wall 322 to selectively engage with at least one of the attachment slots 13 so as to detachably couple the shelf supporting beam 30 between the vertical posts 10 at a position that the beam member 31 is extended between the side surfaces 12 of the vertical posts 10. In particular, two ends of the beam member 31 are rigidly mounted with the two post lockers 32 respectively, wherein each of the extension wall 321 of the post locker 32 has a locker tail 3211 extended to fittingly fill the space underneath the top beam wall 312 at an opposite side of the platform supporting surface 314, as shown in FIG. 4. In other words, the shape of the beam member 31, as shown in FIGS. 4 and 6, is rigidly supported and retained by means of the extension walls 321 of the two post lockers 32 at two ends thereof. Therefore, the top beam wall 312 can be strengthened by the locker tail 3211 when the shelf platform 20 is supported on the platform supporting surface 314.

It is appreciated that, as shown in FIGS. 4 to 6, when the shelf platform 20 as shown in FIG. 8 sits on the platform supporting surface 314 of the beam member 31, the downward force applied on the platform supporting surface 314 is supported and held by supporting wall 312 which is further reinforced by the reinforcing ribs 316 that not only prevent the beam wall from being bent and deformed, but also provide better supporting ability to the supporting wall 312 and the supporting surface 314. It is worth mentioning that two ends of the beam members 31 are coupled at two of the vertical posts 10 via the post lockers 32 respectively, such that the longitudinal reinforcing ribs 316 will generate an anti-twist reinforcing force to reinforce the planar structure of the vertical beam wall 311 so as to prevent any twisting force created thereat. In addition, when the downward force is applied on the platform supporting surface 314 on the recessed beam flange 313, the downward force will transfer to the vertical beam wall 311. Therefore, the reinforcing force from the reinforcing rib 316 will withstand the downward force at the vertical beam wall 311. In other words, the reinforcing ribs 316 will also reinforce the downward force applied on the platform supporting surface 314. Furthermore, by configuring the longitudinal reinforcing rib 316 to have a curved cross section outwardly extended from the vertical beam wall 311, the longitudinal reinforcing rib 316 will also generate a resilient force at the curved portion thereof. The direction of the resilient force of the longitudinal reinforcing rib 316 is opposite to the downward force applied on the platform supporting surface 314, such that the longitudinal reinforcing rib 316 will also enhance the supporting ability of the platform supporting surface 314 to support a heavier load thereon.

Accordingly, the angle between the extension wall 321 and the locker wall 322 matches with the angle between the inner attachment surface 11 of the vertical post 10 and the side surface 12 thereof. Preferably, the angle between the extension wall 321 and the locker wall 322 is 90 degrees. Therefore, when the locking element 323 is engaged with the respective attachment slot 13, the extension wall 321 and the locker wall 322 will overlappedly biased against the side surface 12 and the inner attachment surface 11 of the vertical post 10 respectively. It is worth mentioning that when the locking elements 323 are engaged with the attachment slots 13 respectively, the locker wall 322 is biased against the first inner wall portion 1011 to cover the attachment slots 13. In other words, the corresponding attachment slots 13 are covered by the locker wall 322 once the post locker 32 is coupled at the vertical post 10.

Each of the post lockers 32 further comprises an attachment wall 324 perpendicularly extended from the extension wall 321, wherein the attachment wall 324 is overlappedly attached to the vertical beam wall 311 of the beam member 31. In other words, when the attachment wall 324 is overlappedly attached to the vertical beam wall 311 of the beam member 31, the extension wall 321 is perpendicularly extended from the vertical beam wall 311 of the beam member 31. It is worth mentioning that two opposed edges of the extension wall 321 are integrally extended between the locker wall 322 and the attachment wall 324 at a position that the locker wall 322 and the attachment wall 324 are extended from the extension wall 321 at opposite directions. In other words, the locker wall 322 and the attachment wall 324 are extended in parallel.

The locking element 323 is slidably passed through the upper slot portion 131 of the respective attachment slot 13 and is downwardly slid to engage with the lower slot portion 132 of the attachment slot 13 so as to detachably lock up the beam member 31 with the vertical post 10. In particular, the locking element 323 has an elongated neck portion 3231 extended from the locker wall 322 and an enlarged head portion 3232 extended from a free end of the neck portion 3231. The size of the head portion 3232 of the locking element 323 is smaller than the size of the upper slot portion 131 of the attachment slot 13 and is larger than the size of the lower slot portion 132 of the attachment slot 13. Also, the size of the neck portion 3231 is smaller than the lower slot portion 132 of the attachment slot 13. Therefore, when the head portion 3232 of the locking element 323 passes through the upper slot portion 131 of the attachment slot 13, the neck portion 3231 of the locking element 323 is downwardly slid to engage with the lower slot portion 132 of the attachment slot 13, as shown in FIG. 5. As shown in FIGS. 4 and 5, two locking elements 323 are spacedly provided on the locker wall 322 to detachably engage with two adjacent attachment slots 13 respectively, so as to prevent any unwanted movement between the beam member 31 and the vertical post 10.

Each of the post lockers 32 further comprises a retention wall 325 perpendicularly extended from the locker wall 322 to slidably insert into the retention slot 14 when the locking element 323 is engaged with the attachment slot 13. As shown in FIGS. 4 and 5, the extension wall 321, the locker wall 322, and the retention wall 325 form a U-shaped configuration, wherein a distance between the retention slot 14 and the side surface 12 of the vertical post 10 matches with a distance between the extension wall 321 and the retention wall 325 of the post locker 32. In other words, the extension wall 321 and the retention wall 325 are integrally extended from two opposed edges of the locker wall 322 respectively. Therefore, when the locker wall 322 is biased against the inner attachment surface 11 of the vertical post 10, the extension wall 321 is biased against the side surface 12 of the vertical post 10 while the retention wall 325 is slid into the retention slot 14.

Preferably, two retention walls 325 are spacedly extended from the locker wall 322 at the upper and lower portions thereof respectively. A space is defined between the retention walls 325 along the edge of the locker wall 322, wherein the cross member 40 extended to couple with the retention slot 14 through the space between the retention walls 325.

Therefore, the post locker 32 provides three different locking mechanisms to securely lock up the beam member 31 to the vertical post 10. In particular, the first locking mechanism is that the locking element 323 is engaged with the attachment slot 13 of the vertical post 10. The second locking mechanism is the surface engagement between the extension wall 321 and the side surface 12 of the vertical post 10, and the surface engagement between the locker wall 322 and the inner attachment surface 11 of the vertical post 10. The third locking mechanism is that the retention wall 325 is slidably inserted into the retention slot 14 of the vertical post 10.

It is worth mentioning that when the locking elements 323 at the locker wall 322 are engaged with the attachment slots 13, three surface-engagements of the extension wall 321, the locker wall 322, and the retention wall 325 are provided to couple with the vertical post 10. When the loading force is applied at the beam member 31 through the shelf platform 20, a torque will create at the post locker 32. To overcome the torque at the post locker 32, the extension wall 321 will bias against the side surface 12 of the vertical post 10. In addition, the retention wall 325 will also bias against the inner side of the retention slot 14 of the vertical post 10. In fact, the loading force at the beam member 31 will ensure the engagement between the locking element 323 and the attachment slot 13.

Figure 7:
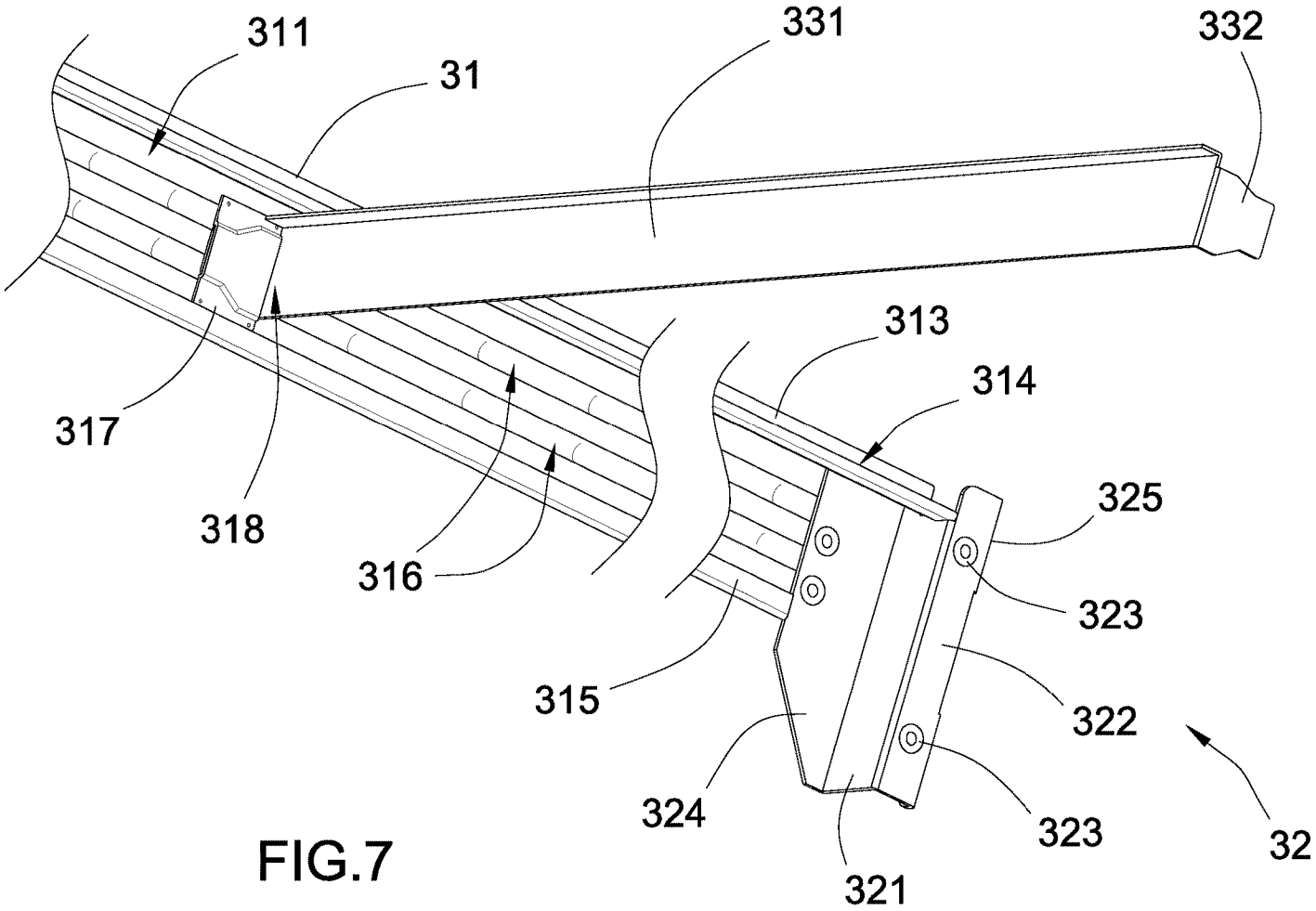
FIG. 7 is a perspective view of the reinforcing member of the shelving apparatus according to the above preferred embodiment of the present invention.

As shown in FIG. 7, the supporting frame further comprises a plurality of reinforcing members 33 extended between two of the beam members 31, wherein the reinforcing members 33 are extended parallelly to the cross members 40 to support the shelf platform 20. Accordingly, each of the beam members 31 further has at least a longitudinal slot 318 formed at an inner side thereof, such that two ends of each of the reinforcing members 33 are detachably engaged with the longitudinal slots 318 of two of the beam members 31 to reinforce the beam members 31 and to retain a fixed distance therebetween. In particular, each of the reinforcing members 33 has a L-shaped reinforcing panel 331 to support the shelf platform 20, and two coupling latches 332 integrally extended from two ends of the reinforcing panel 331 respectively and opposedly extended with each other to slidably engage with the longitudinal slots 318 of two of the beam members 31 respectively. Accordingly, each of the coupling latches 332 is perpendicularly extended from the end of the reinforcing panel 331.

Figure 7A:
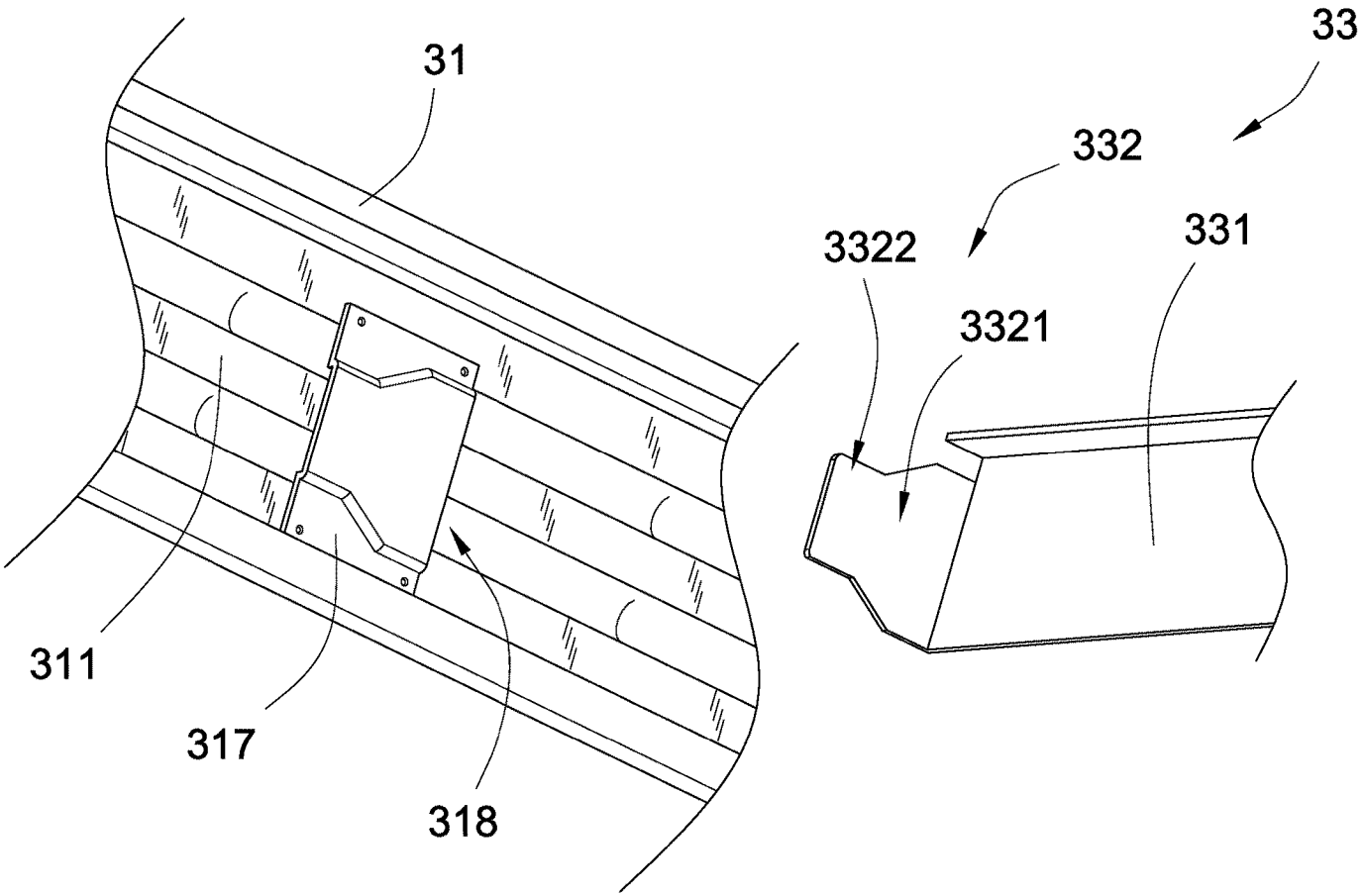
FIG. 7A illustrates an engagement between the reinforcing members and the longitudinal slot according to the above preferred embodiment of the present invention.
Figure 7B:
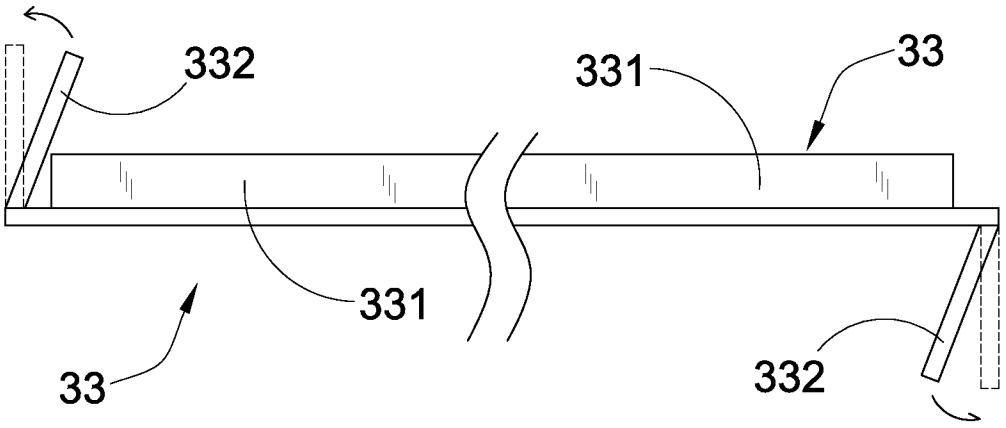
FIG. 7B illustrates the coupling latches being bent inwardly at the end of the reinforcing panel and being bent outwardly for engaging with the longitudinal slots according to the above preferred embodiment of the present invention.
Figure 7C:
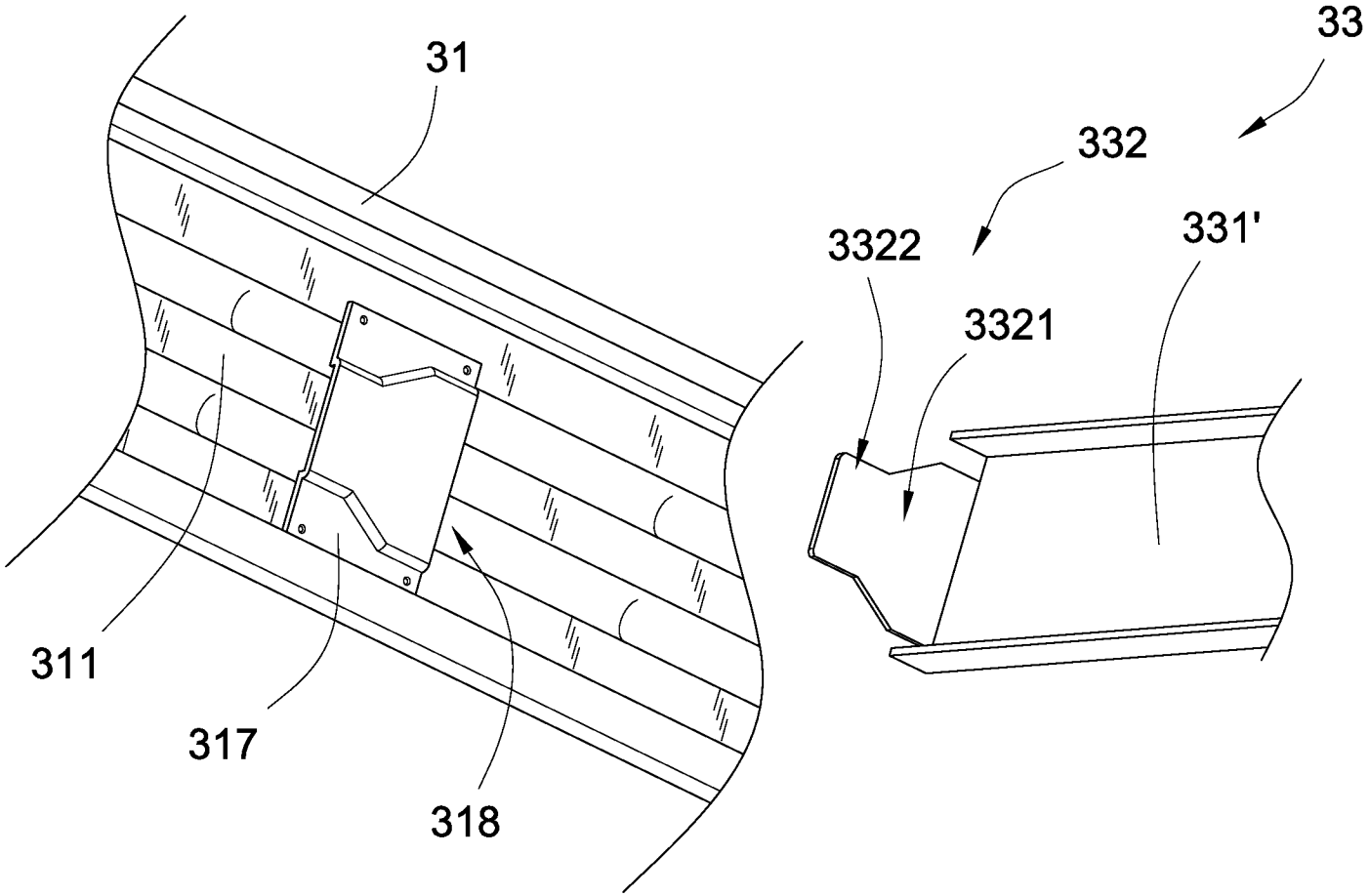
FIG. 7C illustrates an alternative mode of the reinforcing member to have a U-shaped cross section according to the above preferred embodiment of the present invention.

It is appreciated that each of the reinforcing panels 331' can have a U-shaped cross section as shown in FIG. 7C. Accordingly, the reinforcing panel 331, 331' can be configured to have a L-shaped cross section as shown in FIG. 7A or to have a U-shaped cross section as shown in FIG. 7C for enhancing the entire rigidity of the reinforcing panel 331, 331' so as to retain the distance between the beam members 31 when two ends of the reinforcing members 33 are detachably engaged with the longitudinal slots 318 of the beam members 31.

As shown in FIG. 7B, the coupling latches 332 are two flexible panels extended from two ends of the reinforcing panel 331 respectively. In particular, each of the coupling latches 322 is bent inwardly at the end of the reinforcing panel 311 that an angle between the coupling latch 322 and the reinforcing panel 331 is an acute angle. Therefore, when the coupling latches 332 are slidably engaged with the longitudinal slots 318 of the beam members 31 respectively, the coupling latches 332 are bent outwardly to perpendicularly extend from the ends of the reinforcing panel 331. In other words, when the coupling latches 332 are slidably engaged with the longitudinal slots 318 of the beam members 31 respectively, the coupling latches 322 will apply inward resilient forces at the beam members 31 respectively to retain a distance between the beam members 31 and to ensure the engagement between the coupling latches 332 and the longitudinal slots 318.

As shown in FIG. 7A, each of the coupling latches 332 has a tapered latch portion 3321 perpendicularly extended from the end of the reinforcing panel 331 and an inserting end portion 3322 integrally extended from the latch portion 3321. In other words, two slanted edges are defined at the latch portion 3321, wherein the inserting end portion 3322 has a uniform width. In order to form the longitudinal slot 318, a coupling panel 317 is overlappedly attached to the inner side of the beam member 31 to define the longitudinal slot 318 between the coupling panel 317 and the inner side of the beam member 31. In particular, a peripheral edge of the coupling panel 317 is welded to the inner side of the beam member 31, wherein the coupling panel 317 is punched, via a metal punching machine, to form the longitudinal slot 318 with a shape and size corresponding to the shape and size of the coupling latch 332. Therefore, after the inserting end 3322 of the coupling latch 332 is inserted into the longitudinal slot 318, the latch portion 3321 of the coupling latch 332 is frictionally engaged with the longitudinal slot 318 so as to evenly distribute the weight force of the object to the beam members 31 and to prevent any torque generated at the reinforcing members 33 and/or the beam members 31.

As shown in FIG. 8, the shelf platform 20 further has a plurality of guiding notches 23 spacedly formed along the surrounding frame 21, wherein each of the reinforcing members 33 is fitted into the guiding notches 23 when the shelf platform 20 is supported at the second position. It is worth mentioning that at the second position, as shown in FIG. 9B, the base frame 22 is supported by the platform supporting surfaces 314 of the shelf supporting beams 30 at a position that the surrounding frame 21 is located below the base frame 22 to form the boundary-less frame structure.

It is worth mentioning that for the four-leveled supporting frame of the instant invention, the structural configuration of the shelving apparatus can withstand totally 6000 lbs of object without deforming or twisting the supporting frame. In other words, each supporting level of the supporting frame can withstand 1500 lbs of object to be placed thereon without damaging the structure of the shelving apparatus since the weight force of the object can be substantially distributed to the beam members 31 and the vertical posts 10.

Figure 10:
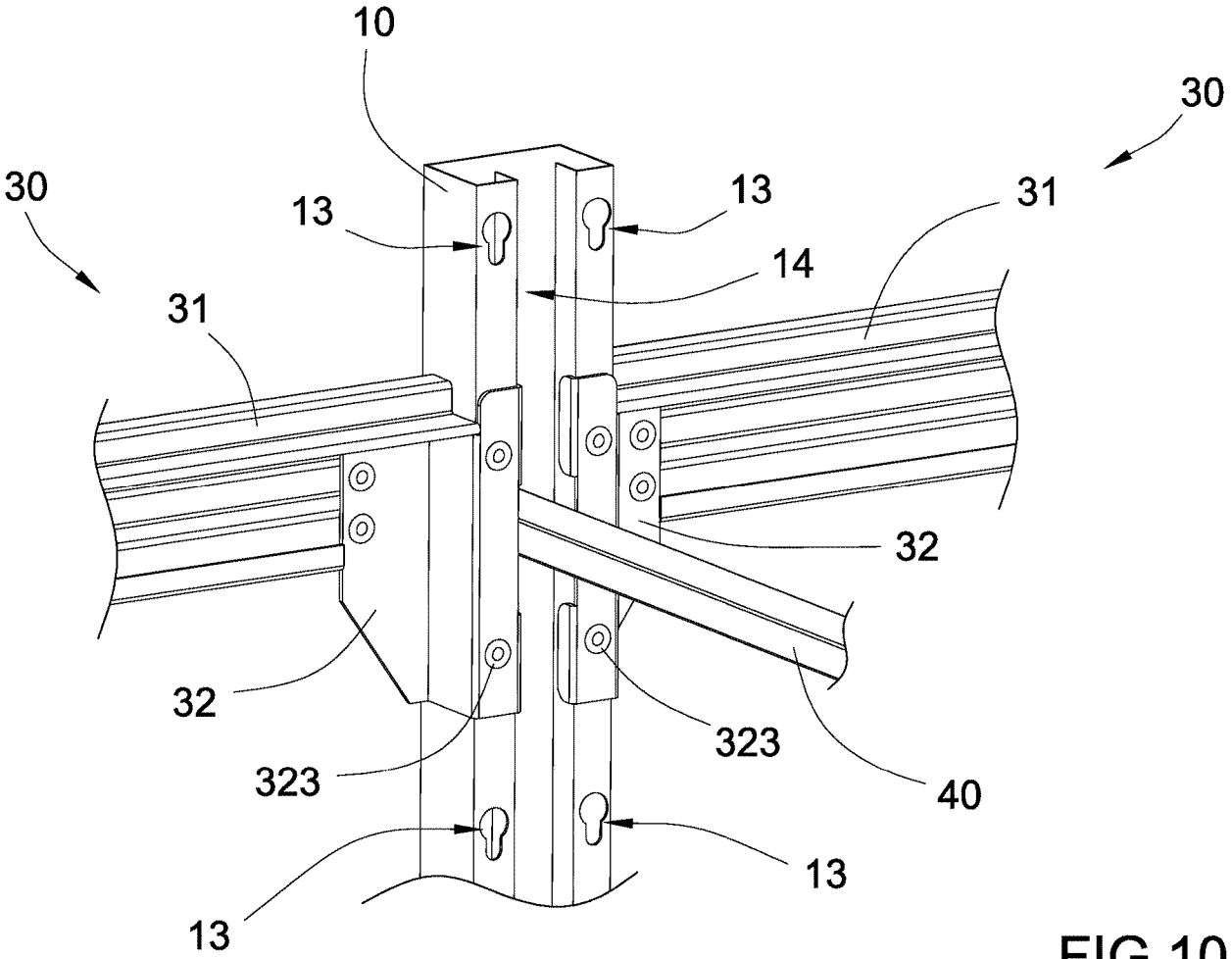
FIG. 10 illustrates two beam members coupling with the vertical post as a common post to expand a longitudinal size of the shelving apparatus.

In addition, two columns of the attachment slots 13 are formed on the inner attachment surface 11 of each of the vertical posts 10, wherein two of the shelf supporting beams 30 are detachably coupled at the vertical post 10 as a common post at the opposite directions as shown in FIGS. 2, 3, and 10 to selectively expand a longitudinal size of the shelving apparatus. In other words, the locking element 323 of one of the shelf supporting beams 30 is engaged with the attachment slot 13 at the first column while the locking element 323 of the other shelf supporting beam 30 is engaged with the attachment slot 13 at the second column, such that the two shelf supporting beams 30 are opposedly extended from the common vertical post 10 and are aligned with each other end-to-end. In other words, two or more shelving apparatus are interconnected side-by-side via the common post to form a multiple shelving apparatus. Therefore, the longitudinal expansion of the shelving apparatus could be unlimited and the object supported thereon will be evenly distributed to the entire structure of the shelving apparatus. It is worth mentioning that when the object is loaded at one of the shelving apparatus, the object can be supported by the multiple shelving apparatus through the common posts. In addition, the multiple shelving apparatus will also provide a stable and rigid support by interlocking the different shelving apparatus with each other via the common posts.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A frame for a shelving apparatus which comprises a shelf platform, comprising:

a plurality of vertical posts, each having an inner attachment surface, a side surface perpendicularly extended from said inner attachment surface, and a plurality of attachment slots spacedly formed at said inner attachment surface, wherein each of said vertical posts further has a vertical retention slot indented on said inner attachment surface;

a plurality of cross members extended between said vertical posts for forming a side boundary of the shelving apparatus, wherein two ends of each of said cross members are detachably coupled at said retention slots of said vertical posts; and a plurality of shelf supporting shelf supporting beams, each of said shelf supporting beams comprising a beam member and two post lockers provided at two ends of said beam member to detachably couple at two of said vertical posts respectively, wherein each of said post lockers comprises an extension wall perpendicularly extended from said beam member to bias against said side surface of said vertical post, a locker wall perpendicularly extended from said extension wall to bias against said inner attachment surface of said vertical post, and at least a locking element provided at said locker wall to selectively engage with at least one of said attachment slots so as to detachably couple said shelf supporting beam between said vertical posts at a position that said beam member is extended between said side surfaces of said vertical posts, wherein each of said post lockers further comprises a retention wall perpendicularly extended from said locker wall to slidably insert into said retention slot when said locking element is engaged with at said attachment slot, wherein two of said retention walls are spacedly extended along an edge of said locker wall to define a space between said two retention walls, wherein an end of said cross member is extended through said space to detachably couple at said retention slot.

2. A frame for a shelving apparatus which comprises a shelf platform, comprising:

a plurality of vertical posts, each having an inner attachment surface, a side surface perpendicularly extended from said inner attachment surface and a plurality of attachment slots spacedly formed at said inner attachment surface;

a plurality of cross members extended between said vertical posts for forming a side boundary of the shelving apparatus;

a plurality of shelf supporting beams, each of said shelf supporting beams comprising a beam member and two post lockers provided at two ends of said beam member to detachably couple at two of said vertical posts respectively, wherein each of said post lockers comprises an extension wall perpendicularly extended from said beam member to bias against said side surface of said vertical post, a locker wall perpendicularly extended from said extension wall to bias against said inner attachment surface of said vertical post, and at least a locking element provided at said locker wall to selectively engage with at least one of said attachment slots so as to detachably couple said shelf supporting beam between said vertical posts at a position that said beam member is extended between said side surfaces of said vertical posts; and a plurality of reinforcing members, wherein each of said beam members has at least a longitudinal slot formed at an inner side thereof, such that two ends of each of said reinforcing members are detachably engaged with said longitudinal slots of two of said beam members to reinforce said beam members and to retain a fixed distance therebetween, wherein each of said reinforcing members has a reinforcing panel and two coupling latches integrally extended from two ends of said reinforcing panel respectively to slidably engage with said longitudinal slots of two of said beam members respectively, wherein said longitudinal slot has a shape and size matching with said coupling latch, wherein each of said coupling latches is bent inwardly at said end of said reinforcing panel that art angle between said coupling latch and said reinforcing panel is an acute angle, such that when said coupling latches are slidably engaged with said longitudinal slots of said beam members respectively, said coupling latches are bent outwardly to perpendicularly extend from said ends of said reinforcing panel.

* * * * *